US007240517B2

(12) United States Patent
Barak

(10) Patent No.: US 7,240,517 B2
(45) Date of Patent: Jul. 10, 2007

(54) FLEXIBLE MESH JEWELRY POUCH

(76) Inventor: Avital Barak, 121 Cassandra Pl., San Ramon, CA (US) 94583

( * ) Notice: Subject to any disclaimer, the term of this patent is extended or adjusted under 35 U.S.C. 154(b) by 79 days.

(21) Appl. No.: 10/798,502

(22) Filed: Mar. 10, 2004

(65) Prior Publication Data

US 2005/0199002 A1 Sep. 15, 2005

(51) Int. Cl.
*A44C 17/02* (2006.01)

(52) U.S. Cl. ..... 63/29.1; 63/28; 63/31; 63/12; 63/3; 63/37; 63/23; 63/40; 383/43; 383/117; 206/6.1; 29/10

(58) Field of Classification Search ..... 63/26, 63/29.1, 30, 31, 21, 1.11, 1.14, 1.18, 12, 13, 63/14.1, 3, 37, 18, 23, 33, 40; 224/600–602, 224/610; 383/117, 43; 206/6.1, 315.9, 315.91
See application file for complete search history.

(56) References Cited

U.S. PATENT DOCUMENTS

| | | | | | |
|---|---|---|---|---|---|
| 328,350 | A | * | 10/1885 | Smith | 294/74 |
| 403,928 | A | * | 5/1889 | Emeric | 383/6 |
| 672,499 | A | * | 4/1901 | Tully | 383/76 |
| 689,232 | A | * | 12/1901 | Schoch | 63/37 |
| 726,166 | A | * | 4/1903 | Irons | 245/4 |
| 808,166 | A | | 9/1908 | Aucoc | 414/546 |
| 898,166 | A | | 9/1908 | Aucoc | |
| 1,084,584 | A | | 1/1914 | Moody | |
| 1,814,378 | A | * | 7/1931 | Gilbertson et al. | 383/117 |
| 2,258,413 | A | * | 10/1941 | Koven | 63/31 |
| D161,954 | S | | 2/1951 | Molinari | |
| 3,483,907 | A | * | 12/1969 | Corridon | 383/76 |
| 5,845,994 | A | * | 12/1998 | Rice | 383/76 |
| 5,974,830 | A | | 11/1999 | Colero | |

FOREIGN PATENT DOCUMENTS

| | | |
|---|---|---|
| CH | 673 207 A5 | 2/1990 |
| FR | 2 763 802 A1 | 12/1998 |

* cited by examiner

*Primary Examiner*—Jack W. Lavinder

(57) ABSTRACT

A flexible jewel pouch for holding a jewel, comprising a metal mesh dimensioned to hold the jewel therein, having a top opening and having a plurality of apertures, the largest aperture being smaller than the jewel; a mesh carrying arrangement slidingly attached to the mesh along the top opening, wherein when the jewel is placed in the mesh, the mesh suspends from the mesh carrying arrangement and the weight of the jewel causes the mesh carrying arrangement to at least partially close the top opening of the mesh thereby securing the jewel therein.

3 Claims, 5 Drawing Sheets

FLEXIBLE MESH JEWELRY POUCH

INCORPORATION BY REFERENCE

Applicant(s) hereby incorporate herein by reference, any and all U.S. patents and U.S. patent applications cited or referred to in this application.

BACKGROUND OF THE INVENTION

1. Field of the Invention

This invention relates generally to a mesh pouch, bag or purse made of a metal chain formed to enclose a jewel and providing advantages as described.

2. Description of Related Art

The following art defines the present state of this field:

Molinari, U.S. Des. 161,954 describes an open mesh knitted shoulder bag design.

Tully, U.S. Pat. No. 672,499 describes a laundry bag consisting of a series of strands converging at the bottom, the said strands being knotted and then lying extending parallel to form a double thickness for the bottom portion; said strands forming loops and a ring in the loops.

Schoch, U.S. Pat. No. 6,89,232 describes a metal cloth of concavo-convex plates each having at its periphery a series of arms bent backwardly and inwardly, and connecting-links with crossheads at opposite ends joining one plate with another.

Irons, U.S. Pat. No. 726,166 describes a chain fabric comprising a plurality of finished chains and links connecting each finished chain with its adjacent finished chain at intervals, all the links of each finished chain being connected in rows, and links of the finished chains being cross-connected by links to form meshes of which the finished chains are two sides and the connecting links are the other two sides.

Aucoc, U.S. Pat. No. 898,166 describes a metallic web or fabric for the purposes specified, comprising a plurality of rings connected in groups, each ring having a central inset portion provided with a setting for the reception of ornamental stones, and each group of rings being centrally connected by a member comprising a stud having a head and a setting therein; and the rings of said groups being connected in pairs by links.

Moody, U.S. Pat. No. 1,084,584 describes a green food feeder for poultry and the like comprising a tubular reticulated container member of flexible material, a spreader member within said container at the bottom thereof and having an aperture therein, the marginal meshes of one end of said container passing through said aperture and fastened on the opposite side of said spreader member.

Rice, U.S. Pat. No. 5,845,994 describes a holding device including a mesh container having a closed end and an opposite open end defining an interior. A tassel may hang from the container proximate the closed end. The mesh container may be formed by a plurality of strands braided and tied together in a series of knots such that a diamond-shape weave appears. A drawstring is inserted through the interstices of the mesh at the open end of the container. A cinching mechanism, such as a draw bead, slidably engages the drawstring for opening and closing the open end of the container. The drawstring may have a connecting ring for enhancing safety.

The prior art above teaches: a mesh bag, a metallic web or fabric, a metal cloth for purses, chatelaine bags etc., a laundry bag, a green food feeder for poultry, an open mesh knitted shoulder bag, and a purse or the like, but does not teach a combination mesh pouch with closure and enclosed jewel wherein the weight of the jewel is sufficient to close the mesh pouch. The present invention fulfills these needs and provides further related advantages as described in the following summary.

SUMMARY OF THE INVENTION

In accordance with one aspect of the present invention, there is provided a flexible jewel pouch for holding a jewel, comprising a metal mesh dimensioned to hold the jewel therein, a top opening and having a plurality of apertures, the largest aperture being smaller than the jewel; a mesh carrying arrangement slidingly attached to the mesh along the top opening, wherein when the jewel is placed in the mesh, the mesh suspends from the mesh carrying arrangement and the weight of the jewel causes the mesh carrying arrangement to at least partially close the top opening of the mesh thereby securing the jewel therein.

In accordance with one embodiment of the present invention, the mesh jewel pouch is formed using a bottom ring for closing a bottom end of the jewel pouch. Extending upwardly from the bottom ring are a plurality of metal chain strands forming a mutually spaced-apart chain-strand adjacency relationship around the bottom ring. Each one of the chain strands is joined to its neighbor strands on either side by attachment rings to form an open mesh fabric. Terminal ends of the strands are joined to slider rings on a jewel support band so that with a jewel held within the jewel pouch, and with the jewel pouch suspended from the jewel support band by the slider rings, the weight of the jewel is sufficient to cause the slider rings to slide along the jewel support band into mutual adjacency for closing a top end of the jewel pouch for capturing the jewel therein.

The present invention further provides a jewelry kit comprising in combination: at least one jewel pouch as described above and at least two jewels each of which is capable of fitting into the mesh and having at least one visual characteristic different one from the other. Thus, for example the jewels may differ in their color such as to achieve different jewel arrangement by the replacement of a jewel having one color with a jewel of another color and to thereby obtain different adornments.

A primary objective of the present invention is to provide an apparatus and method of use of such apparatus that yields advantages not taught by the prior art.

Another objective is to provide such an invention capable of being worn for adornment.

A further objective is to provide such an invention capable of replacement of one jewel with another jewel selectively without the need for a jewelry mechanic.

A still further objective is to provide such an invention capable of holding a jewel and securing the jewel by its own weight.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 4:
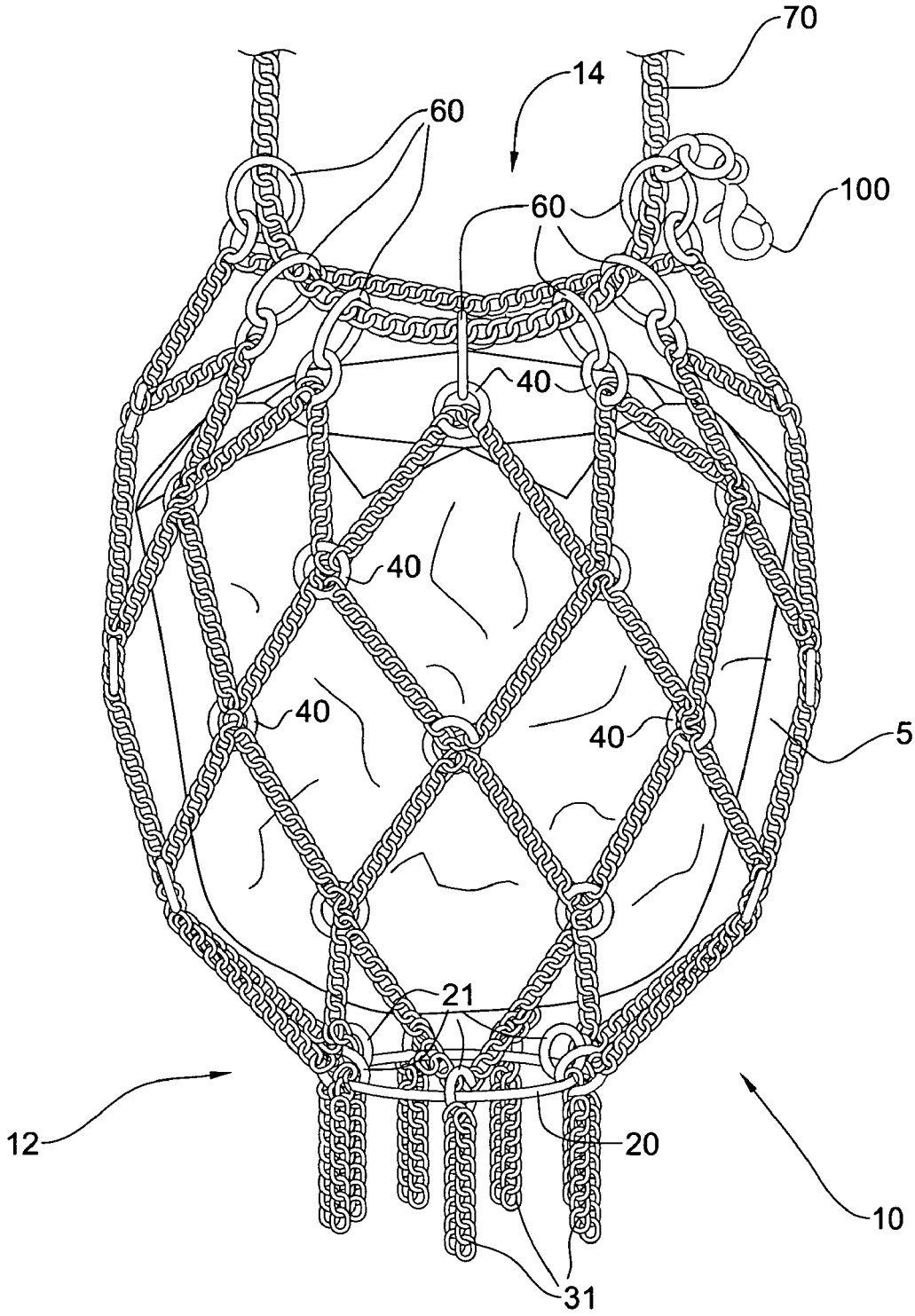
FIG. 4 is an elevational view of the jewel pouch of the invention as formed with the strands, with a jewel or stone enclosed therein and partly cut away to display a rear top portion of the jewel pouch.
Figure 6:
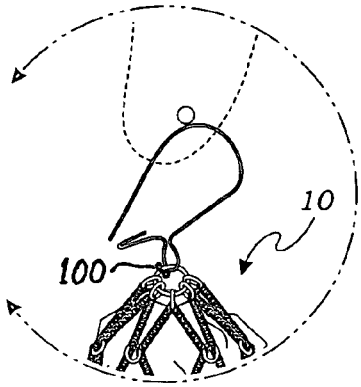
FIG. 6 is an enlarged partial view of FIG. 5 showing details of the earring embodiment.

The present invention is a mesh jewel pouch 10 formed using a bottom ring 20 of sufficient rigidity and strength for closing a bottom end 12 of the jewel pouch 10, which as described below, will support and enclose a jewel 5 of a significant weight (FIG. 4). The word "jewel" in this specification and in the claims to follow shall include in its meaning, precious and semi-precious gems, stones, crystals and like objects without exception.

Figure 1:
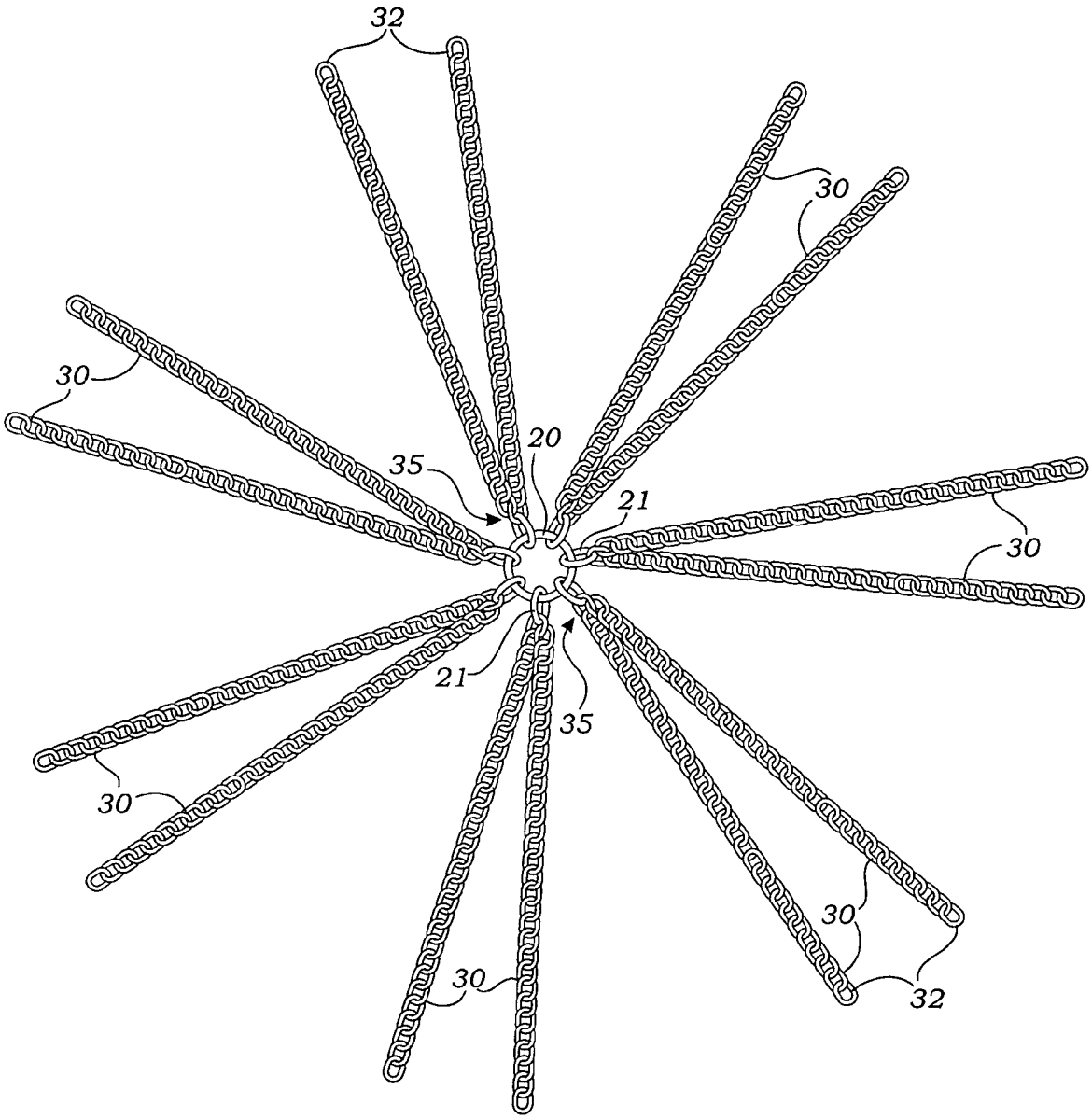
FIG. 1 is a plan view of chain strands of the invention configured in V-formations and attached around a bottom ring of the invention at the apex of the V-formations.
Figure 2:
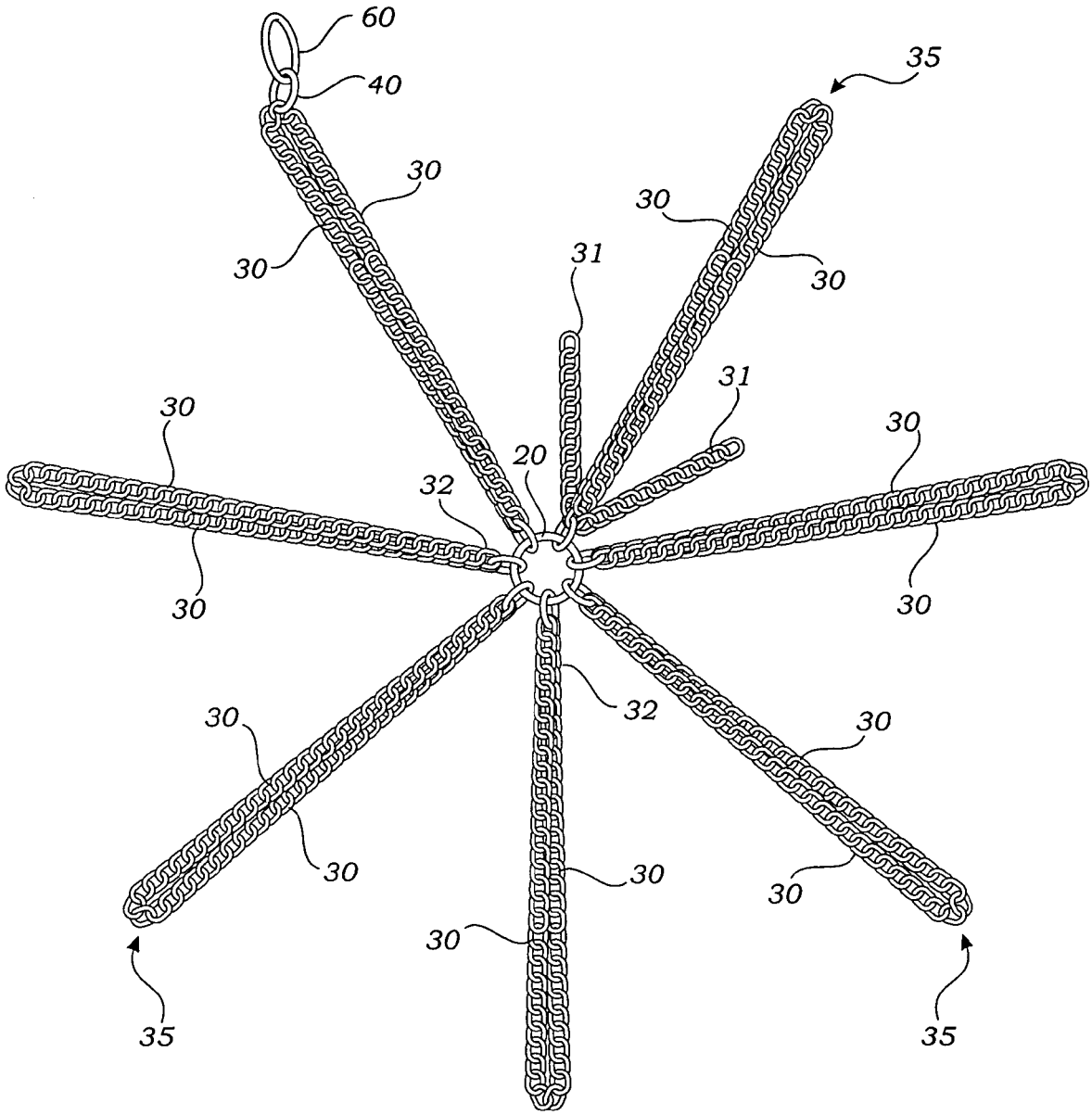
FIG. 2 is a plan view of chain strands of the invention configured in V-formations and attached around a bottom ring of the invention at the ends of the V-formations.

Attached to, and extending upwardly from the bottom ring 20 are a plurality of highly flexible, jewelry quality metal chain strands 30 forming a mutually spaced-apart chain-strand adjacency relationship around the bottom ring 20 as shown in FIGS. 1 and 2. That is, the strands 30 are movable on the bottom ring 20 and are preferably attached to the bottom ring 20 using rings 21 somewhat larger than the links of the strands 30.

Preferably, the strands 30 are made up of chains having a length equal to the length of two of the strands 30, and the chains are then folded in half at a midpoint 35 of the chains to form two V-shaped strands 30. In one approach, the midpoint 35 of the strands is attached to the bottom ring 20, as shown in FIG. 1, while in a second embodiment, the free ends of the V-shaped strands 30 are attached to the bottom ring 20 as shown in FIG. 2.

Figure 3:
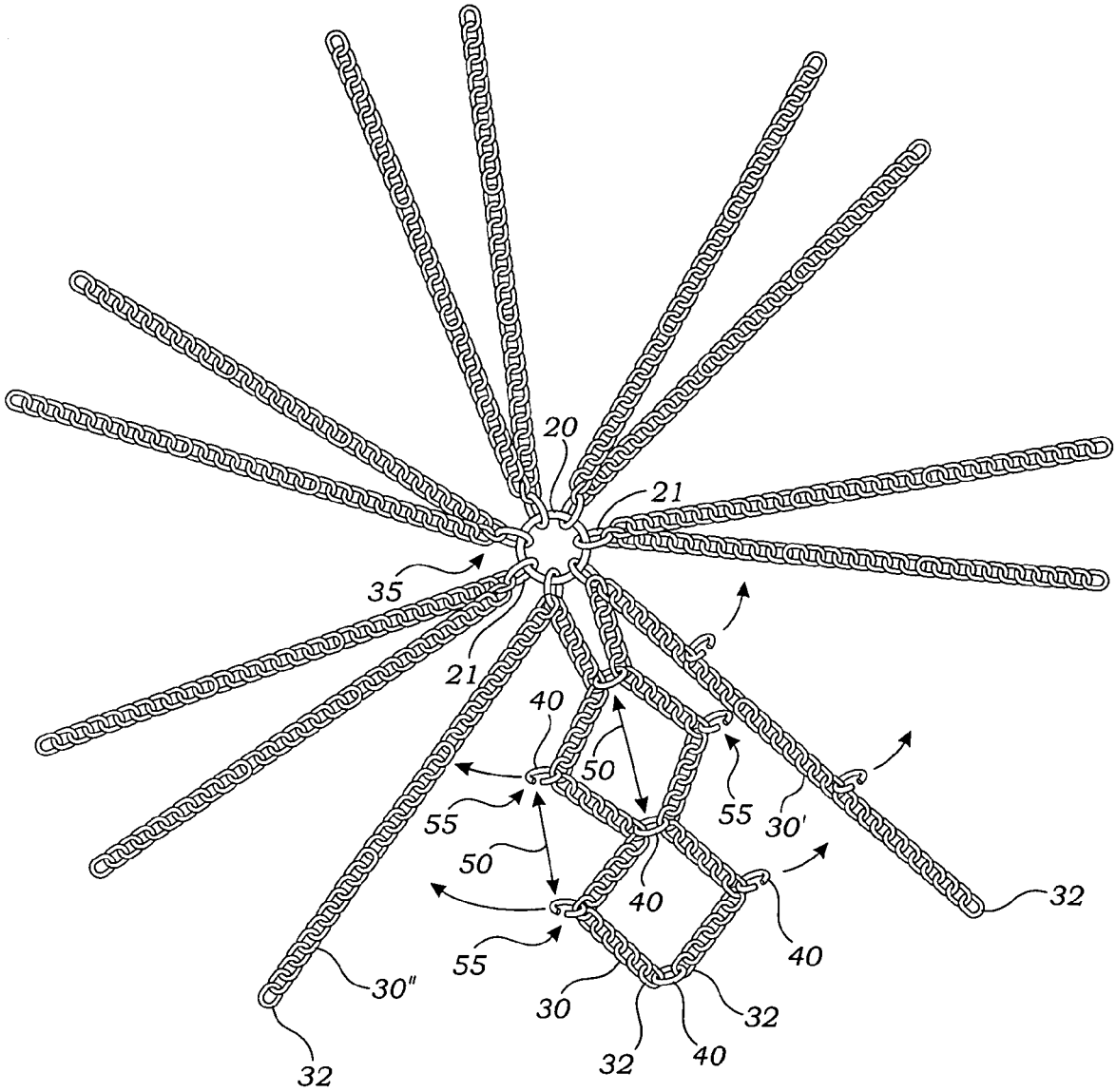
FIG. 3 is a plan view of the chain strands of FIG. 1, showing the method of attachment of adjacent strands to each other.

In either case, each one of the chain strands 30 is joined to another strand (e.g. an adjacent/neighboring one) of the chain strands, identified by the numeral 30' in FIG. 3, by one of a plurality of attachment rings 40 at spaced-apart intervals 50, and to a second adjacent one of the chain strands, identified by the numeral 30" in FIG. 3, at points 55 within the intervals 50.

The intervals 50 may be of a constant dimension, or may vary across the pouch 10. Likewise, the pattern of the strands 30 may be of various shapes and other than the diamond shape shown in FIG. 4. In this manner, the jewel pouch 10 is constructed with a plurality of apertures which may be of any one of a wide range of shapes and said shapes may vary within a pouch.

Figure 5:
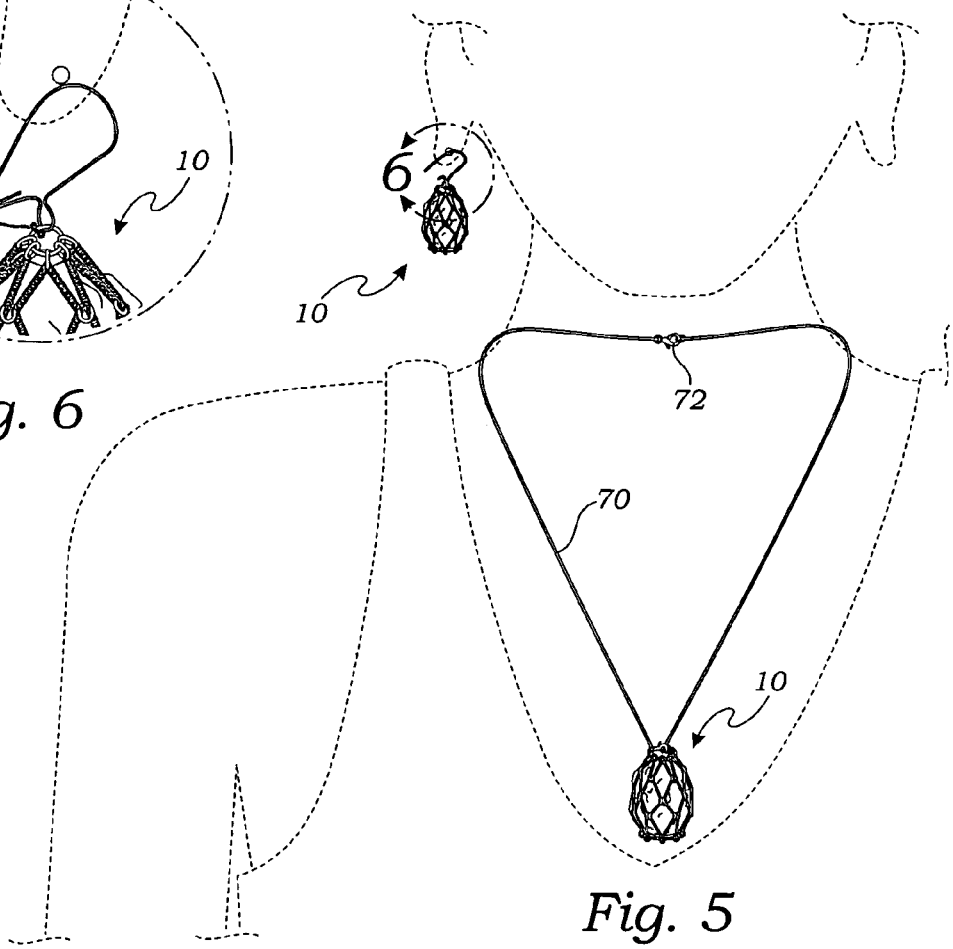
FIG. 5 is an elevational view thereof showing a necklace embodiment and an earring embodiment.
Figure 7:
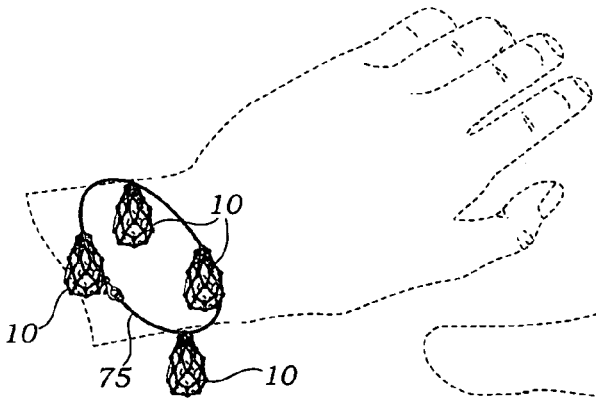
FIG. 7 is an elevational view thereof showing a bracelet embodiment.
Figure 8:
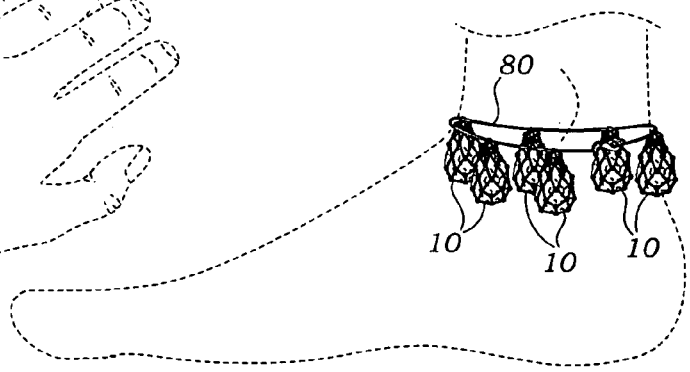
FIG. 8 is an elevational view thereof showing an anklet embodiment.

When the midpoint 35 of each chain is fastened to the bottom ring, as defined in FIGS. 1 and 3, the terminal ends 32 of each of the chain strands 30, 30', 30" is engaged with a slider ring 60 and is therefore slidingly engaged with a pouch support means, typically a necklace 70, having a clasp means 72 for closing the necklace 70 in a continuous loop (FIG. 5), or with a bracelet 75 (FIG. 7) or with an anklet 80 (FIG. 8). However, when the midpoint 35 is fastened to the slider ring 60 (FIG. 2), the free ends 32 of chain strands 30 are attached to the bottom ring 20, via rings 21, and indeed, may extend below as a fringe 31 (FIG. 4).

The jewel 5 is held within the jewel pouch 10, wherein with the jewel pouch 10 suspended from the jewel support means by the slider rings 60, the weight of the jewel 5 is sufficient to cause the slider rings 60 to slide along the jewel support means into mutual adjacency for closing a top end 14 of the jewel pouch 10 for capturing the jewel 5 therein. Preferably, a safety clasp 100 (FIG. 4) is engaged with at least two of the slider rings 60 for securing the jewel pouch 10 in a top-closed attitude as shown in FIGS. 5-8.

A plurality of the jewel pouch 10, as described above, may be mounted onto a single necklace (not shown), bracelet (FIG. 7) or anklet (FIG. 8) and these are preferably placed in fixed, spaced apart locations as shown in the figures.

The enablements described in detail above are considered novel over the prior art of record and are considered critical to the operation of the instant invention and to the achievement of the above described objectives. The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A method for applying and wearing a jewel for ornamentation, comprising:

(a) providing a jewelry apparatus having at least one jewel pouch, comprising an ornamental metal mesh dimensioned to hold a jewel therein, said mesh having a top opening and having a plurality of apertures, the largest aperture being smaller than said jewel; a mesh carrying arrangement being slidingly attached to the mesh along the top opening; wherein upon placing the jewel in the mesh, the mesh suspends from the mesh carrying arrangement and the weight of the jewel causes the mesh carrying arrangement to at least partially close the top opening of the mesh thereby securing the jewel therein;

(b) selecting a jewel and placing it within the pouch; and (c) securing the apparatus about an individual's neck through the mesh carrying arrangement, wherein said carrying arrangement is a necklace;

(d) providing a second jewel, removing the selected jewel from the pouch, and placing the second jewel within the pouch.

2. A method for applying and wearing a jewel for ornamentation, comprising:

(a) providing a jewelry apparatus having at least one jewel pouch, comprising an ornamental metal mesh dimensioned to hold a jewel therein, said mesh having a top opening and having a plurality of apertures, the largest aperture being smaller than said jewel; a mesh carrying arrangement being slidingly attached to the mesh along the top opening; wherein upon placing the jewel in the mesh, the mesh suspends from the mesh carrying arrangement and the weight of the jewel causes the mesh carrying arrangement to at least partially close the top opening of the mesh thereby securing the jewel therein;

(b) selecting a jewel and placing it within the pouch; and (c) securing the apparatus on an individual through the mesh carrying arrangement, wherein said carrying arrangement is a bracelet, an anklet or an earring and said apparatus is worn on the individual's wrist, ankle or ear;

(d) providing a second jewel, removing the selected jewel from the pouch, and placing the second jewel within the pouch.

3. A method for constructing an ornamental piece to be worn by an individual, comprising:

providing a jewelry apparatus having at least one jewel pouch, comprising an ornamental metal mesh dimensioned to hold a jewel therein, said mesh having a top opening and having a plurality of apertures; a mesh carrying arrangement being slidingly attached to the mesh along the top opening; wherein upon placing the jewel in the mesh, the mesh suspends from the mesh carrying arrangement and the weight of the jewel causes the mesh carrying arrangement to at least partially close the top opening of the mesh thereby securing the jewel therein; the mesh carrying arrangement being adapted for wearing the apparatus on the individual; and selecting a jewel of size larger than the largest aperture of said jewel pouch; placing said jewel within the pouch and removing the selected jewel and placing another jewel within the pouch.

* * * * *